US005429739A

United States Patent [19]

Hanks et al.

[11] Patent Number: 5,429,739

[45] Date of Patent: Jul. 4, 1995

[54] PITCH PRECURSOR PRODUCTION BY DISTILLATION

[75] Inventors: Robert S. Hanks, Proctorville, Ohio; Bobby K. Friley, Ashland, Ky.

[73] Assignee: Ashland Inc., Ashland, Ky.

[21] Appl. No.: 934,986

[22] Filed: Aug. 25, 1992

[51] Int. Cl.[6] ..... C10G 27/00

[52] U.S. Cl. ..... 208/4; 208/22; 208/39

[58] Field of Search ..... 208/4, 22, 39

[56] References Cited

U.S. PATENT DOCUMENTS

| | | | |
|---|---|---|---|
| 4,013,540 | 3/1977 | Moyle et al. | 208/4 |
| 4,017,327 | 4/1977 | Lewis | 423/447.4 |
| 4,209,500 | 6/1980 | Chwastiak | 208/22 |
| 4,474,617 | 10/1984 | Uemura et al. | 208/4 |
| 4,497,789 | 2/1985 | Sawran et al. | 208/22 |
| 4,671,864 | 6/1987 | Sawran et al. | 208/22 |
| 4,892,641 | 1/1990 | Fu et al. | 208/4 |
| 4,892,642 | 1/1990 | Romine et al. | 208/4 |
| 4,904,371 | 2/1990 | Kalback | 208/4 |
| 4,996,037 | 2/1991 | Berkebile et al. | 208/39 |
| 4,999,099 | 3/1991 | Fu et al. | 208/39 |

*Primary Examiner*—Helane E. Myers
*Attorney, Agent, or Firm*—Richard C. Willson, Jr.

[57] ABSTRACT

An improved wiped film evaporator (WFE) process for removing low molecular weight species from a hydrocarbyl mixture is disclosed, wherein partial oxidation of a hydrocarbyl mixture precedes the WFE step. Faster rates of distillation are achieved without significant deterioration of hydrocarbyl product properties. Such products can include carbon fiber precursor materials. Similar faster rates are provided by adding higher softening point hydrocarbyl materials with or without prior partial oxidation.

14 Claims, No Drawings

PITCH PRECURSOR PRODUCTION BY DISTILLATION

Cross Reference to Related Application

U.S. Pat. No. 4,497,789, issued Feb. 5, 1985 (Attorney Docket No. 3902OUS) relates to the general field of the present invention.

BACKGROUND OF THE INVENTION

1. Field of the Invention

This invention broadly relates to distillation of hydrocarbyl materials. But more particularly, this invention relates to hydrocarbyl materials comprising a mixture of high and low boiling components, wherein the mixture has a softening point in the range 200° F. to 600° F., as determined in accordance with a modification of ASTM D-3461 (modified ASTM D-3461). The modifications to ASTM D-3461 consist of a stainless steel ball of appropriate dimensions instead of the lead ball, a nitrogen purge exists throughout the heating cell, and testing may be performed to temperatures >180° C.

A softening point throughout this specification and claims is intended to mean that temperature determined and in accordance with modified ASTM D-3461, unless otherwise specifically stated.

Hydrocarbyl material throughout this specification and claims shall mean a material having: a percent by weight of hydrogen in the range 4% to 16%; a percent by weight of carbon in the range of at least 80%, more preferably at least 85% by weight, most preferably at least 90% by weight; a percent by weight of nitrogen in the range 0% to 3%; and percent by weight of sulfur in the range 0% to 4%. The percents by weight are all based upon the total weight of the hydrocarbyl material. Hydrocarbyl material can be pitches derived from petroleum or coal tar.

A WFE process for purposes of this specification and claims includes any process that subjects a thin film to elevated temperatures and reduced pressure to evolve lower molecular weight or more easily volatilized components from higher molecular weight or heavier residues. A WFE process can more narrowly involve: forming a layer on a heated surface while simultaneously providing a pressure in the range 50 to 1,000 microns of mercury (Hg), preferably in the range 100 to 950 microns of Hg. The temperature for the heated surface is generally in the range 600° F. to 850° F., preferably 650° F. to 800° F., and still more preferably 700° F. to 760° F. Generally the layers have thicknesses in the range 0.01 to 0.1 inches, preferably 0.02 to 0.05 inches. The letters "WFE" were selected because a wiped film evaporator can be used to carry out one such WFE process.

2. Description of the Prior Art

Although the invention deals with hydrocarbyl materials in general, this invention is more specifically directed to transforming pitch-like materials from one softening point to another so that they become suitable carbon fiber precursor materials. The carbon fiber precursor materials of this invention are preferably most suitably used in melt blowing of carbon fibers. Examples of melt blowing technology can be found in U.S. Pat. Nos. 4,285,655 to Matsubra; 4,295,809 to Madami; 3,825,380 to Harding; and 4,497,789 to Sawran, et al.

Oxidation of pitch is known to be useful in converting low molecular weight specie, pitch-based materials to higher molecular weight, and higher softening point materials. This is particularly true in the case of roofing fluxes derived from petroleum residuum.

Conoco reports that oxidation of certain mesophase precursors led to a material that could, with heat soaking, be converted into a mesophase material. This is reported in U.S. 4,892,642 of Romine et al., issued Jan. 9, 1990, in a patent entitled *Process for the Production of Mesophase*, and U.S. 4,892,641 of Fuet al., entitled *Process for the Production of Mesophase Pitch*, issued Jan. 9, 1990. In each patent, a carbonaceous feedstock substantially free of mesophase pitch is heated at elevated temperature in the presence of an oxidatively reactive sparging gas. Subsequent heat soaking and heat treatment of the oxidized isotropic carbonaceous feed is reported to have resulted in substantial quantities of mesophase.

In a paper entitled *Air-Blowing Reactions of Coal Tar Pitch I. Properties of Pitch Modified By Air-Blowing* (T. Maeda, et al. *Ext. Abst. Nineteenth Biennial Conference on Carbon*, University Park, Pa., p.180 (1989)), researchers of Osaka Gas Company Limited report air-blowing of petroleum derived carbonaceous materials to result in isotropic pitches being produced. Air-blowing was reported as a recognized procedure to raise the softening point temperature and coking value of petroleum derived carbonaceous materials. Hence, the procedure is asserted to be applicable and desirable for producing precursor pitch for isotropic general purpose carbon fibers.

U.S. 4,999,099 of Ta Wei Fu and Manfred Katz discloses a process for heating a carbonaceous feedstock at mesophase-forming temperatures while simultaneously passing a sparging gas containing an oxidative component selected from the group consisting of $O_2$, $O_3$, $H_2O_2$, formic acid vapor, and/or hydrochloric acid vapor with an inert gas component to produce a mesophase pitch that is reported to be especially suitable for the manufacture of carbon fibers. The process involves partial oxidation and partial removal of volatile components as a result of the sparging gas. Not disclosed are any methods for improving the mixing or interaction between the sparging gas and the pitch. In contrast to the instant invention, the disclosed purpose of '099 is to produce mesophase.

U.S. 4,209,500 of Chwastiak, issued Jun. 24, 1980, discloses a process for making high mesophase content pitch in which carbonaceous feed is heated with agitation and a passing of an inert gas through the pitch.

U.S. 3,976,729 and 4,017,327, both issued to Lewis, et al., involve agitating a carbonaceous starting material while heat treating same. In DE No. 2221707 and DE No. 2357477, patent applications of Koppers Company, Inc., the manufacture of isotropic carbon fibers is disclosed. The starting material for carbon fibers is first oxidized with oxygen and then vacuum distilled to remove non-oxidized lower boiling components.

One of the objects of the instant invention is to increase the rate at which a WFE process is carried out. The WFE process is used in this instant invention to increase the softening point of a low softening point hydrocarbyl material. For example, a hydrocarbyl material having a softening point of approximately 250° F. can be increased by means of a WFE process to remove lower molecular weight, more volatile components to produce a higher softening point carbon fiber precursor material. An example of such a process is disclosed in U.S. Pat. Nos. 4,497,789, issued Feb. 5, 1985 (Attorney 5Docket No. 3902OUS), and 4,996,037, issued Feb. 26, 1991.

A pitch such as characterized in the following Table I can be processed in a WFE to produce a carbon fiber precursor material, such as given in Table II, suitable for melt blowing into stabilizable carbon fibers.

TABLE I

TYPICAL ANALYSIS FOR A COMMERCIAL PITCH (A-240)

| Test | Method | Typical Value |
|---|---|---|
| Softening Point, °C. | modified ASTM D-3461 | >105° |
| Density, g/cm$^3$, 25° C. | Beckman Pycnometer | 1.23 |
| Coking Value, wt % | ASTM D-2416 | 52 |
| Flash, COC, °C. | ASTM D-92 | 312 |
| Ash, wt % | ASTM D-2415 | <0.1 |
| Toluene Insolubles, wt % | ASTM D-4072 | 8 |
| Quinoline Insolubles, wt % | ASTM D-2318 | <0.5 |
| Sulfur, wt % | ASTM D-1552 | 2.5 |
| Carbon, wt % | | 91 |
| Hydrogen, wt % | | 6 |
| Distillation, wt % | ASTM D-2569 | |
| 0–270° C. | | 0 |
| 270–300° C. | | 0 |
| 300–360° C. | | 2.45 |
| Specific Heat | Calculated | |
| −5° C. | | 0.271 cal/g |
| 38° C. | | 0.299 cal/g |
| 93° C. | | 0.331 cal/g |
| 140° C. | | 0.365 cal/g |
| Viscosity, cP | Brookfield LVT Viscometer, Spindle #18 | |
| RPM | | |
| 325° F. 1.5 | | 2734 |
| 350° F. 1.5 | | 866 |
| 375° F. 1.5 | | 362 |
| 400° F. 3.0 | | 162 |

TABLE II

PROPERTIES OF CARBON FIBERS PRECURSOR MATERIAL

| Property | ASTM Test Number | Value |
|---|---|---|
| Softening Point, °C. | modified ASTM D-3461 | At least 249 |
| Toluene Insolubles, wt % | D-4072 | 20–40 |
| Coking Value, wt % | D-2416 | 65–90 |
| Helium Density, g/cm$^3$ | * | At about 1.25–1.32 |
| Sulfur, wt % | D-1552 | 0.1–4.0 |
| Carbon, wt % | | 90–95 |
| Hydrogen, wt % | | 3–7 |
| Ash, wt % | ASTM D-2415 | <0.1 |
| Quinoline Insolubles, wt % | ASTM D-2318 | <0.5 |

*Determined by Beckman Pycnometer g/cm$^3$ at 25° C.

Accordingly, it is one of the objects of this invention to provide a method for producing uniform softening points of hydrocarbyl materials in high yields at commercially useful rates. A commercially useful throughput for a WFE such as sold by Artisan Industries, Inc. of Walthain, Mass., U.S.A., or The Pfaudler Co., Division of Sybron Corporation of Rochester, N.Y., U.S.A., achievable by this invention is an output of at least 3 lb/hr/ft$^2$, preferably at least 5 lb/hr/ft$^2$, and most preferably at least 7 lb/hr/ft$^2$.

It is still another object of this invention to increase the rate at which material such as A-240 pitch can be converted into useful carbon fiber precursor feed for melt blowing or melt spinning. In U.S. Pat. No. 4,497,789, filed Dec. 3, 1982, (Attorney Docket No. 3902OUS) several methods are disclosed for converting A-240 pitch and pitches of that character having a softening point of approximately 250° F. to a material having a softening point in the range of 450° F. to 530° F. A preferred method for producing carbon fiber precursor feeds involves the use of a WFE. Use of a WFE to produce melt blowing carbon fiber precursor material is disclosed in U.S. 4,996,037, issued Feb. 26, 1991.

Were one to take a 250° F. softening point isotropic pitch and introduce it into a WFE, the rate of output from the WFE is roughly 3–5 lb/hr/ft$^2$. Accordingly, it would be desirable to find a way to increase the rate at which a pitch can be processed to higher softening points in conjunction with a WFE.

These and other objects that will become clear based upon this disclosure have been found achievable by the processes of this invention.

SUMMARY OF THE INVENTION

1. General Statement of the Invention

We have found, in a mixture comprising an oxidized pitch and a substantially unoxidized pitch, that a 2° F. softening point increase, relative to the softening point of the unoxidized pitch alone, is usually necessary in order to observe a measurable increase in WFE process rate. Clearly, as the volume fraction of oxidized pitch increases, and/or as the softening point of the oxidized pitch fraction increases, there will be an increasing rate at which the WFE process can be carried out. What is surprising and important for purposes of understanding this invention, is that if there is too much oxidation then the pitch fiber precursor materials sought may not have the necessary and suitable properties for a melt blowing process. It is important to appreciate that whenever anything is added to a pitch that is processed in a melt blow die, such additional materials may have dramatic and adverse impacts on the fiber produced.

We have found that it is possible to partially oxidize an isotropic pitch so as to increase its rate of processing in a WFE process but without adversely impacting the fibers produced from it in a melt blowing process.

One example of this invention comprises the following: A hydrocarbyl is first oxidized to increase its softening point from one in the range 230° to 280° F. to another in the range 250° to 300° F. Subsequently, a portion of this oxidized material is thoroughly mixed with an unoxidized portion of either this material or a material compatible with it, so as to form a mixture which is then passed through a WFE. The surprising and unexpected benefit of this invention is that the rate at which material can be passed through the WFE can be substantially increased without any loss in yield. Though the percent-by-weight yield does not change in this process, the rate at which one is able to obtain suitable hydrocarbyl species as carbon fiber precursors is surprisingly and dramatically increased. In other words, the residence time within the WFE is substantially decreased without loss of quality in the carbon fiber precursor materials or the products made therefrom.

There are many methods known in the art of partially oxidizing an initial or starting isotropic pitch. However, to be useful, the softening point obtained by such oxidation should be controllable to an average standard deviation of no more than ±5° F., preferably less than ±2° F. and ideally no more than ±1° F. Such partially oxidized isotropic pitch can be transferred preferably without further processing directly into a WFE process. Alternatively and within the scope of this intended :invention is the process of oxidizing a portion of the initial or starting isotropic pitch and then by blending or mixing, to distribute such oxidized isotropic pitch as an oxidized blending component throughout the initial isotropic pitch prior to passing such mixture through a WFE process. Mixtures comprising at least one oxidized blending component and the initial or starting isotropic pitch are discussed in more detail in the examples. Mixtures comprising at least 1.0% to 60% by volume of an oxidized blending component and 90% to 40% by weight of the initial isotropic pitch are particularly suitable for this invention.

2. Utility of the Invention

Broadly, this invention is directed to increasing the production rate that is achievable by means of a WFE process.

As an important feature of the instant invention, pitch-fiber precursor materials are prepared from coal or petroleum-based pitches. The pitch fiber precursor material suitable for this invention is intended to be suitable for melt blowing, and accordingly, must satisfy certain rigid constraints. The isotropic pitch most suitable for this invention is disclosed in U.S. 4,497,789 to Sawran, et al. Preferably the isotropic pitch described in the previous reference has sufficient alpha and beta carbon so that stabilization and carbonization is facilitated. To minimize loss of alpha and beta alkyl carbons on aromatic nuclei, preferably, a WFE process is employed. Further, the preferred isotropic pitch of this invention, before and after processing, has less than 5% by weight mesophase, still more preferably less than 2% by weight of mesophase and ideally less than 1% by weight of mesophase. We have discovered surprisingly and unexpectedly that oxidation can increase the rate that volatile components can be removed from isotropic pitch in a WFE process to increase the softening point of the pitch without severe loss of alpha and beta aliphatic carbons. A preferred method of measuring of throughput for a WFE process normalizes throughput as a function of film surface area available in the WFE. This then takes into account that the WFE process will have increasing throughput as the surface area on which the film or layer is prepared is increased. For example, a WFE having a heated surface of 13.4 square feet to produce an initial layer having a thickness of about 0.03 inches was found to have a carbon fiber precursor material production rate in the range of 56 lb/hr. However, after at least a partial oxidation of the isotropic pitch feed from a softening point of 240° F. to about 275° F., when blended with 70% unoxidized isotropic pitch feed, WFE production of carbon fiber precursor material increased to 90 lb/hr.

In general, whenever pitch is oxidized, one observes an increase in softening point as measured according to modified ASTM D-3461.

We have found that if an initial isotropic pitch is partially oxidized to increase its softening point by at least 2° F., preferably by a least 10° F., and still more preferably by at least 20° F., and generally in the range 2° F. to 30° F., preferably in the range 2° F. to 40° F. such partially oxidized pitch can be processed by means of a WFE process (as described and defined in this disclosure) more rapidly than if it had not been at least partially oxidized prior to such processing.

There is, however, a point of diminishing returns. If too much oxidation is carried out, then the partially oxidized pitch material will no longer be suitable as a pitch fiber precursor material. What is surprising and interesting about the present invention is that there exists an amount of oxidation which can be carried out on an initially isotropic pitch, such that after a WFE process it is suitable as a fiber precursor material. Too much oxidation may improve the throughput rate of a WFE process, but the viscosity of the final material produced after the WFE process makes it unsuitable for use as a pitch fiber precursor material for melt blowing or melt spinning. The melt viscosities at 450° F. of an isotropic pitch suitable for producing carbon fiber precursor material are in the range of 50 cP to 300 cP.

We have discovered that this appropriately oxidized isotropic pitch material, either alone or mixed with an unoxidized isotropic pitch, such as given in Table I, yields a feedstock that substantially increases WFE production of a melt blowable carbon fiber precursor material. By "substantially" is meant a "measurable," and preferably at least a 1% increase in rate, and more preferably at least 2% to 100% increase in rate of a WFE process.

Whenever a percent by weight (or volume) is mentioned throughout this specification and claims, the percent by weight (or volume) is based upon the total composition. In the case of a mixture, it is based upon total weight of the mixture, unless volume percents are expressly stated. In cases where there are ranges of percent by weights which on summation can, depending upon parts of the relevant ranges selected, exceed 100, such compositions are outside the scope intended for this invention.

EXAMPLE

A method of oxidizing an isotropic pitch, suitable for this invention, comprises the following: A slipstream of molten 250° F. softening point WFE pitch feedstock is pumped to a plug flow oxidation reactor. The reactor contains static mixing elements specifically designed for efficient mixing of gas and liquid systems. Reactor length and diameter are configured to maintain a liquid residence time of approximately 20 minutes and a liquid velocity of at least 0.07 ft/sec.

Heated air is dispersed into the liquid stream at the reactor entrance. Approximately one standard cubic foot of air is introduced per pound of pitch feedstock. The following parameters were found to be particularly effective in achieving efficient and controlled oxidation of the molten pitch feedstock:

Reactor Temperature (° F.) 500–650
Reactor Pressure (psi): 10–90

Upon exiting the reactor, and prior to entering the WFE unit, molten 295° F. softening point oxidized pitch is separated from offgases, and combined with molten 250° F. softening point WFE pitch feedstock to form a thoroughly mixed 30 wt % blend of oxidized pitch in non-oxidized pitch. Given comparable WFE operation parameters, the blended feedstock allowed carbon fiber precursor pitch production rates to be increased almost 60% relative to that of the non-oxidized pitch alone; i.e., from 4.2 lb/hr/ft$^2$ to 6.7 lb/hr/ft$^2$.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the invention disclosed herein. It is also contemplated by this invention that other additives may be added to the hydrocarbyl feed to further improve its oxidation properties. For example, it is known that branch-chain hydrocarbons and other materials mentioned in U.S. 4,192,812, issued Mar. 11, 1980, of D. D. Carlos; U.S. 4,199,431, issued Apr. 22, 1980, of D. D. Carlos; 4,456,524 of R. H. Wombles et al., issued Jun. 24, 1982; and 4,544,411 of D. D. Carlos et al., issued Oct. 1, 1985, will catalyze oxidation of hydrocarbyl species. Another variation of this embodiment could consist of adding materials other than molecular oxygen as oxidizing agents. Examples of suitable and possible oxidizing agents are nitrogen oxides, ozone, nitrates such as nitric acid and the like. And still another modification of this invention could be the addition of polymers such as polyethylene or polypropylene to the carbon fiber precursor materials produced in this invention. Such addition can occur prior to oxidation or subsequent to oxidation as a material added to the hydrocarbon material just prior to being introduced into a WFE. A less desirable but still possible modification is to introduce the polyethylene or polypropylene subsequent to treatment in the WFE but prior to melt spinning or melt blowing. The preferred method of mixing would be by means of an extruder. Still another variation contemplated by this invention is that in place of a WFE, a devolatilizing screw feeder suitable for degassing of thermoplastic materials could be used to increase the throughput of the degassing extruder. And in still another variation on this invention, mixers other than static mixers can be used, provided they will produce a requisite amount of micro bubbles dispersed through the A-240 like pitch.

Reference made to any patent or other literature in this or any other specification cited herein is intended to result in such patent or literature being expressly incorporated herein by reference, including any patents or other literature references cited within such patents or literature.

Any explicit range for a process parameter, such as temperature, pressure, or composition is intended to expressly incorporate in this specification each and every value for each such process parameter within any explicit range relevant to each such process parameter and any range within any such explicit range. For example, a temperature range of 0° F. to 212° F. is intended to include every temperature, such as 50° F., that is within the temperature range of 0° F. to 212° F., including functional equivalents thereof, and any range such as 50° F. to 75° F. within the temperature range of 0° F. to 212° F.

What is claimed is:

1. An improved process for producing a higher softening point pitch from a lower softening point pitch precursor comprising about 4% to 16% by weight hydrogen and at least 85% by weight carbon by a thin film process that subjects a thin film to elevated temperatures and reduced pressure to evolve lower molecular weight or more easily volatilized components from higher molecular weight or heavier residues at a rate; wherein the improvement comprises: a separating and partially oxidizing at least a portion of said precursor to form an oxidized precursor having a higher softening point than said precursor prior to said thin film process and b forming a mixture of said precursor with an amount of said oxidized precursor sufficient to increase said rate by at least 1% for said mixture relative to that of said precursor alone, when all other factors that influence said thin film process are kept constant.

2. The improved process of claim 1, wherein said partial oxidizing step comprises use of air.

3. The improved process of claim 1, wherein said oxidized precursor has a softening point as determined in accordance with modified ASTM D-3461 that is increased by at least 2° F. above the softening point of said precursor.

4. The improved process of claim 1, wherein said softening point of said oxidized precursor is at least 5° F., as determined in accordance with modified ASTM D-3461 above the softening point of said precursor.

5. The improved process of claim 1, wherein said softening point of said oxidized precursor is increased by at least 10° F., as determined in accordance with modified ASTM D-3461.

6. The improved process of claim 1, wherein said oxidized precursor has a softening point as determined in accordance with modified ASTM D-3461 that is increased by an amount in the range 2° F. to 30° F.

7. The improved process of claim 1, wherein said amount of said oxidized precursor comprises 10% to 60% by volume of said mixture.

8. The improved process of claim 1, wherein said precursor comprises a pitch derived from either coal or petroleum.

9. The improved process of claim 1, wherein said partially oxidizing said precursor comprises forming a mixture by mixing into said precursor an amount of said oxidized precursor having a higher softening point as measured in accordance with modified ASTM D-3461; wherein said amount is sufficient to increase said rate.

10. The improved process of claim 9, wherein said amount of said oxidized precursor comprises 10% to 60% by volume of said mixture.

11. The improved process of claim 1, wherein said thin film has a thickness in the range 0.01 to 0.1 inches, said surface is at a temperature in the range 600° F. to 850° F., and a pressure in the range 50 to 1,000 microns of Hg is applied to said thin film.

12. The improved process of claim 1, wherein said oxidized precursor is a fiber precursor pitch characterized by having the following properties:

Softening Point (by modified ASTM D-3461 ): at least 249° C.;
Ash (by ASTM D-2415): less than 0.1 wt%:
Toluene Insolubles (by D-4072): 20–40 wt %;
Quinoline Insolubles (by ASTM D-2318): less than 0.5 wt%;
Coking Value (by D-2416): 65–90 wt %;
Sulfur (by D-1552): 0.1–4.0 wt %;
Carbon: 90–95 wt %; and
Hydrogen: 3–7 wt %.

13. An improved process for producing a higher softening point pitch from a lower softening point pitch precursor comprising 4% to 16% hydrogen at least 85%, carbon by a process that subjects a thin film to elevated temperatures and reduced pressure to evolve lower molecular weight or more easily volatilized components from higher molecular weight or heavier residues in a thin film process wherein the improvement comprises: adding a partially oxidized pitch to said lower softening point pitch precursor to form a mixture prior to performing said thin film process in an amount sufficient to increase said thin film process of said mixture relative to rate for said lower softening point pitch precursor alone, when all other factors that influence said thin film process are kept constant.

14. The process of claim 13, wherein said amount to increase said thin film process relative to rate for said lower softening point pitch precursor alone, when all other factors that influence said thin film process are kept constant, is at least 1%.

* * * * *